US009552806B2

(12) United States Patent
Kayama et al.

(10) Patent No.: US 9,552,806 B2
(45) Date of Patent: Jan. 24, 2017

(54) SOUND SYNTHESIZING APPARATUS

(71) Applicant: Yamaha Corporation, Hamamatsu-shi, Shizuoka-Ken (JP)

(72) Inventors: Hiraku Kayama, Hamamatsu (JP); Motoki Ogasawara, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 178 days.

(21) Appl. No.: 13/777,994

(22) Filed: Feb. 26, 2013

(65) Prior Publication Data

US 2013/0262121 A1 Oct. 3, 2013

(30) Foreign Application Priority Data

Mar. 28, 2012 (JP) ..... 2012-074858

(51) Int. Cl.

| | |
|---|---|
| ***G10L 13/00*** | (2006.01) |
| ***G10L 13/04*** | (2013.01) |
| ***G10L 13/06*** | (2013.01) |
| ***G10L 13/10*** | (2013.01) |
| *G10L 13/027* | (2013.01) |

(52) U.S. Cl.

CPC ..... *G10L 13/04* (2013.01); *G10L 13/06* (2013.01); *G10L 13/10* (2013.01); *G10L 13/027* (2013.01); *G10L 13/043* (2013.01); *G10L 2013/105* (2013.01)

(58) Field of Classification Search

CPC ..... G10L 13/04; G10L 13/06; G10L 13/07; G10L 13/10; G10L 13/027; G10L 13/043

USPC ..... 704/235, 248, 253, 258–269

See application file for complete search history.

(56) References Cited

U.S. PATENT DOCUMENTS

| | | | | |
|---|---|---|---|---|
| 5,479,564 | A * | 12/1995 | Vogten et al. | 704/267 |
| 6,088,671 | A * | 7/2000 | Gould et al. | 704/235 |
| 6,240,384 | B1 * | 5/2001 | Kagoshima et al. | 704/220 |

(Continued)

FOREIGN PATENT DOCUMENTS

| | | | |
|---|---|---|---|
| CN | 101334994 | A | 12/2008 |
| EP | 1 617 408 | A2 | 1/2006 |

(Continued)

OTHER PUBLICATIONS

JPO Machine Translation of JP 2011128186 A.*

(Continued)

*Primary Examiner* — Richard Zhu

(74) *Attorney, Agent, or Firm* — Morrison & Foerster LLP

(57) ABSTRACT

A sound synthesizing apparatus includes a processor coupled to a memory. The processor configured to execute computer-executable units comprising: an information acquirer adapted to acquire synthesis information which specifies a duration and an utterance content for each unit sound; a prolongation setter adapted to set whether prolongation is permitted or inhibited for each of a plurality of phonemes corresponding to the utterance content of the each unit sound; and a sound synthesizer adapted to generate a synthesized sound corresponding to the synthesis information by connecting a plurality of sound fragments corresponding to the utterance content of the each unit sound. The sound synthesizer prolongs a sound fragment corresponding to the phoneme the prolongation of which is permitted in accordance with the duration of the unit sound.

11 Claims, 5 Drawing Sheets

(56) References Cited

U.S. PATENT DOCUMENTS

| | | | | |
|---|---|---|---|---|
| 6,330,538 | B1 * | 12/2001 | Breen | 704/260 |
| 6,470,316 | B1 * | 10/2002 | Chihara | 704/267 |
| 7,031,922 | B1 * | 4/2006 | Kalinowski et al. | 704/271 |
| 7,546,241 | B2 * | 6/2009 | Yamada et al. | 704/260 |
| 7,877,259 | B2 * | 1/2011 | Marple et al. | 704/260 |
| 8,214,216 | B2 * | 7/2012 | Sato | 704/258 |
| 8,346,557 | B2 * | 1/2013 | Kurzweil et al. | 704/260 |
| 8,504,368 | B2 * | 8/2013 | Katae | G10L 13/10 704/258 |
| 2001/0037202 | A1 * | 11/2001 | Yamada et al. | 704/258 |
| 2004/0102973 | A1 * | 5/2004 | Lott | G10L 13/00 704/254 |
| 2006/0015344 | A1 | 1/2006 | Kemmochi | |
| 2006/0136214 | A1 * | 6/2006 | Sato | 704/265 |
| 2008/0319754 | A1 * | 12/2008 | Nishiike | G10L 13/10 704/260 |
| 2008/0319755 | A1 | 12/2008 | Nishiike et al. | |

FOREIGN PATENT DOCUMENTS

| | | | |
|---|---|---|---|
| JP | 2001-343987 | A | 12/2001 |
| JP | 2002-123281 | A | 4/2002 |
| JP | 2004-258562 | A | 9/2004 |
| JP | 2006-071931 | A | 3/2006 |
| JP | 04-265501 | B2 | 5/2009 |
| JP | 2011-023363 | A | 2/2011 |
| JP | 2011128186 | A * | 6/2011 |

OTHER PUBLICATIONS

Search Report by Registered Searching Organization (Feb. 15, 2016) from JPO prosecution of JP2012-074858A.*

Assessment on Search Report by Registered Searching Organization (Feb. 22, 2016) from JPO prosecution of JP2012-074858A.*

Demol, M. et al. (Oct. 17, 2005). "Efficient Non-Uniform Time-Scaling of Speech with WSOLA," SPECOM, XX, XX, pp. 163-166.

European Search Report mailed Jun. 7, 2013, for European Patent Application No. 13158187.8, 7 pages.

Tihelka, D. et al. (Sep. 1, 2011). "Generalized Non-uniform Time Scaling Distribution Method for Natural-Sounding Speech Rate Change," Text, Speech and Dialogue, Springer Berlin Heidelberg, Berlin, Heidelbert, pp. 147-154.

Chinese Search report dated Mar. 13, 2015 for CN Patent Application No. 201310104780, filed Mar. 28, 2013, with English translation, four pages.

Notification of the first Office Action dated Mar. 13, 2015 for CN Patent Application No. 201310104780, filed Mar. 28, 2013, with English translation, 15 pages.

Chinese Search report dated Oct. 23, 2015 for CN Patent Application No. 201310104780, filed Mar. 28, 2013, with English translation, four pages.

Notification of the Second Office Action dated Oct. 23, 2015 for CN Patent Application No. 201310104780, filed Mar. 28, 2013, with English translation, 20 pages.

Notification of Reasons for Refusal dated Mar. 8, 2016, for JP Patent Application No. 2012-074858, with English translation, ten pages.

* cited by examiner

SOUND SYNTHESIZING APPARATUS

BACKGROUND

The present disclosure relates to a technology to synthesize a sound.

A fragment connection type sound synthesizing technology has conventionally been proposed in which the duration and the utterance content (for example, lyrics) are specified for each unit of synthesis such as a musical note (hereinafter, referred to as "unit sound") and a plurality of sound fragments corresponding to the utterance content of each unit sound are interconnected to thereby generate a desired synthesized sound. According to JP-B-4265501, a sound fragment corresponding to a vowel phoneme among a plurality of phonemes corresponding to the utterance content of each unit sound is prolonged, whereby a synthesized sound which is the utterance content of each unit sound uttered over a desired duration can be generated.

There are cases where, for example, a polyphthong (a diphthong, a triphthong) consisting of a plurality of vowels coupled together is specified as the utterance content of one unit sound. As a configuration for ensuring a sufficient duration with respect to one unit sound for which a polyphthong is specified as mentioned above, for example, a configuration is considered in which the sound fragment of the first one vowel of the polyphthong is prolonged. However, with the configuration in which the object to be prolonged is fixed to the first vowel of the unit sound, there is a problem in that synthesized sounds that can be generated are limited. For example, assuming a case where an utterance content "fight" (one syllable) containing a polyphthong where a vowel phoneme /a/ and a vowel phoneme /I/ are continuous in one syllable is specified as one unit sound, although a synthesized sound "[fa:It]" where the first phoneme /a/ of the polyphthong is prolonged can be generated, a synthesized sound "[fal:t]" where the rear phoneme /I/ is prolonged cannot be generated (the symbol ":" means prolonged sound). While a case of a polyphthong is shown as an example in the above description, when a plurality of phonemes are continuous in one syllable, a similar problem can occur irrespective of whether they are vowels or consonants. In view of the above circumstances, an object of the present disclosure is to generate a variety of synthesized sounds by easing such restriction when sound fragments are prolonged.

SUMMARY

In order to achieve the above object, according to the present invention, there is provided a sound synthesizing method comprising:

acquiring synthesis information which specifies a duration and an utterance content for each unit sound;

setting whether prolongation is permitted or inhibited for each of a plurality of phonemes corresponding to the utterance content of the each unit sound; and generating a synthesized sound corresponding to the synthesis information by connecting a plurality of sound fragments corresponding to the utterance content of the each unit sound, wherein in the generating process, a sound fragment corresponding to the phoneme the prolongation of which is permitted, among a plurality of phonemes corresponding to the utterance content of the each unit sound, is prolonged in accordance with the duration of the unit sound.

For example, in the setting process, whether the prolongation of each of the phonemes is permitted or inhibited is set in response to an instruction from a user.

For example, the sound synthesizing method further comprises: displaying a set image which provides a plurality of phonemes corresponding to the utterance content of a unit sound selected by the user among a plurality of unit sounds specified by the synthesis information for accepting from the user an instruction as to whether the prolongation of each of the phonemes is permitted or inhibited.

For example, the sound synthesizing method further comprises: displaying on a display device a phonemic symbol of each of the plurality of phonemes corresponding to the utterance content of the each unit sound so that a phoneme the prolongation of which is permitted and a phoneme the prolongation of which is inhibited are displayed in different display modes.

For example, in the display modes, a phonemic symbol having at least one of highlighting, an underlined part, a circle, and a dot is applied to the phoneme the prolongation of which is permitted.

For example, in the setting process, whether the prolongation is permitted or inhibited for, of the plurality of phonemes corresponding to the utterance content of the each unit sound, a sustained phoneme which is sustainable timewise is set.

For example, the sound synthesizing method further comprises: displaying a set image which provides a plurality of phonemes corresponding to the utterance content of a unit sound selected by the user among a plurality of unit sounds specified by the synthesis information for accepting from the user an instruction as to durations of the phonemes, wherein in the setting process, the sound fragments corresponding to the utterance content of the unit sound are prolonged so that duration of each of the phonemes corresponding to the utterance content of the unit sound conform with a ratio among the durations of the phonemes specified by the instruction accepted in the set image.

According to the present invention, there is also provided a sound synthesizing apparatus comprising:

a processor coupled to a memory, the processor configured to execute computer-executable units comprising:

an information acquirer adapted to acquire synthesis information which specifies a duration and an utterance content for each unit sound;

a prolongation setter adapted to set whether prolongation is permitted or inhibited for each of a plurality of phonemes corresponding to the utterance content of the each unit sound; and a sound synthesizer adapted to generate a synthesized sound corresponding to the synthesis information by connecting a plurality of sound fragments corresponding to the utterance content of the each unit sound, wherein the sound synthesizer prolongs among a plurality of phonemes corresponding to the utterance content of the each unit sound, a sound fragment corresponding to the phoneme the prolongation of which is permitted in accordance with the duration of the unit sound.

According to the present invention, there is also provided a computer-readable medium having stored thereon a program for causing a computer to implement the sound synthesizing method.

According to the present invention, there is also provided a sound synthesizing method comprising:

acquiring synthesis information which specifies a duration and an utterance content for each unit sound;

setting whether prolongation is permitted or inhibited for at least one of a plurality of phonemes corresponding to the utterance content of the each unit sound; and generating a synthesized sound corresponding to the synthesis information by connecting a plurality of sound fragments corresponding to the utterance content of the each unit sound, wherein in the generating process, a sound fragment corresponding to the phoneme the prolongation of which is permitted, among a plurality of phonemes corresponding to the utterance content of the each unit sound, is prolonged in accordance with the duration of the unit sound.

BRIEF DESCRIPTION OF THE DRAWINGS

The above objects and advantages of the present disclosure will become more apparent by describing in detail preferred exemplary embodiments thereof with reference to the accompanying drawings, wherein.

DETAILED DESCRIPTION OF EXEMPLARY EMBODIMENTS

First Embodiment

Figure 1:
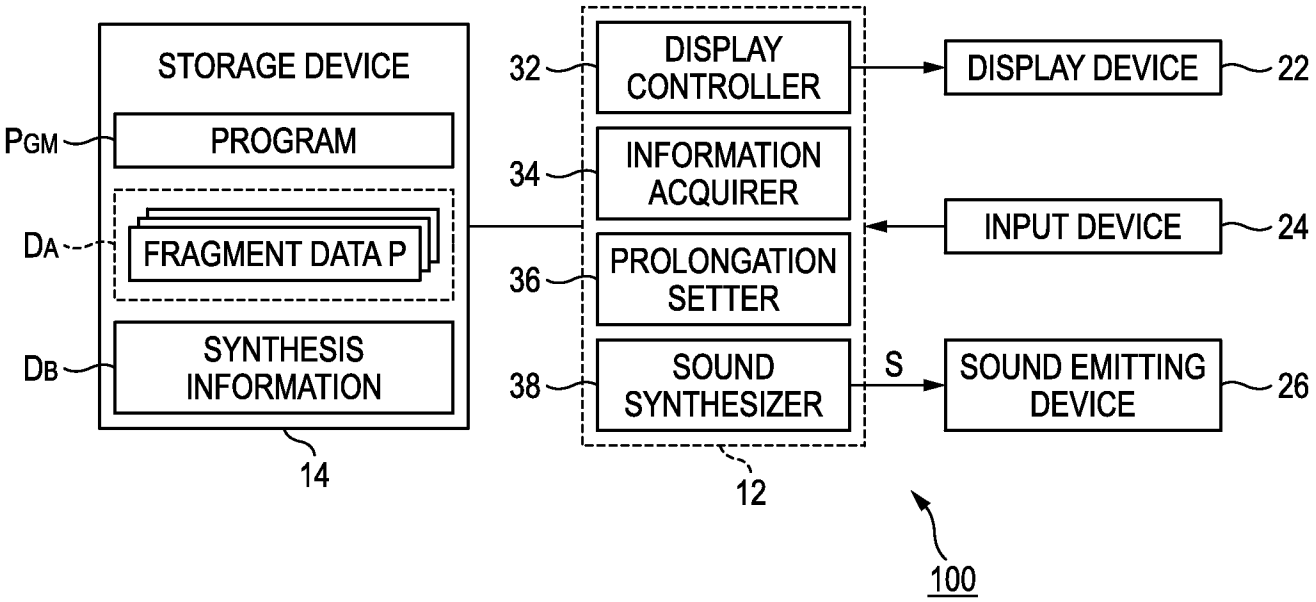
FIG. 1 is a block diagram of a sound synthesizing apparatus according to a first embodiment of the present disclosure.

FIG. 1 is a block diagram of a sound synthesizing apparatus 100 according to a first embodiment of the present disclosure. The sound synthesizing apparatus 100 is a signal processing apparatus that generates a sound signal S of a singing sound by the fragment connection type sound synthesis, and as shown in FIG. 1, is implemented as a computer system which includes an arithmetic processing unit 12, a storage device 14, a display device 22, an input device 24 and a sound emitting device 26. The sound synthesizing apparatus 100 is implemented, for example, as a stationary information processing apparatus (a personal computer) or a portable information processing apparatus (a portable telephone or a personal digital assistance).

The arithmetic processing unit 12 executes a program PGM stored in the storage device 14, thereby implementing a plurality of functions (a display controller 32, an information acquirer 34, a prolongation setter 36 and a sound synthesizer 38) for generating the sound signal S. The following configurations may also be adopted: a configuration in which the functions of the arithmetic processing unit 12 are distributed to a plurality of apparatuses; and a configuration in which a dedicated electronic circuit (for example, DSP) implements some of the functions of the arithmetic processing unit 12.

The display device 22 (for example, a liquid crystal display panel) displays an image specified by the arithmetic processing unit 12. The input device 24 is a device (for example, a mouse or a keyboard) that accepts instructions from the user. A touch panel structured integrally with the display device 22 may be adopted as the input device 24. The sound emitting device 26 (for example, a headphone or a speaker) reproduces a sound corresponding to the sound signal S generated by the arithmetic processing unit 12.

The storage device 14 stores the program PGM executed by the arithmetic processing unit 12 and various pieces of data (a sound fragment group DA, synthesis information DB) used by the arithmetic processing unit 12. A known recording medium such as a semiconductor storage medium or a magnetic recording medium, or a combination of a plurality of kinds of recording media can be freely adopted as the storage device 14.

The sound fragment group DA is a sound synthesis library constituted by the pieces of fragment data P of a plurality of kinds of sound fragments used as sound synthesis materials. The pieces of fragment data P each define, for example, the sample series of the waveform of the sound fragment in the time domain and the spectrum of the sound fragment in the frequency domain. The sound fragments are each an individual phoneme (for example, a vowel or a consonant) which is the minimum unit when a sound is divided from a linguistic point of view (monophone), or a phoneme chain where a plurality of phonemes are coupled together (for example, a diphone or a triphone). The fragment data P of the sound fragment of the individual phoneme expresses the section, in which the waveform is stable, of the sound of continuous utterance of the phoneme (the section during which the acoustic feature is maintained stationary). On the other hand, the fragment data P of the sound fragment of the phoneme chain expresses the utterance of transition from a preceding phoneme to a succeeding phoneme.

Phonemes are divided into phonemes the utterance of which is sustainable timewise (hereinafter, referred to as "sustained phonemes") and phonemes the utterance of which is not sustained (or is difficult to sustain) timewise (hereinafter, referred to as "non-sustained phonemes"). While a typical example of the sustained phonemes is vowels, consonants such as affricates, fricatives and liquids (nasals) (voiced consonants, voiceless consonants) can be included in the sustained phonemes. On the other hand, the non-sustained phonemes are phonemes the utterance of which is momentarily executed (for example, a phoneme uttered through a temporary deformation of the vocal tract that is in a closed state). For example, plosives are a typical example of the non-sustained phonemes. There is a difference that the sustained phonemes can be prolonged timewise whereas the non-sustained phonemes are difficult to prolong timewise with an auditorily natural sound being maintained.

Figure 2:
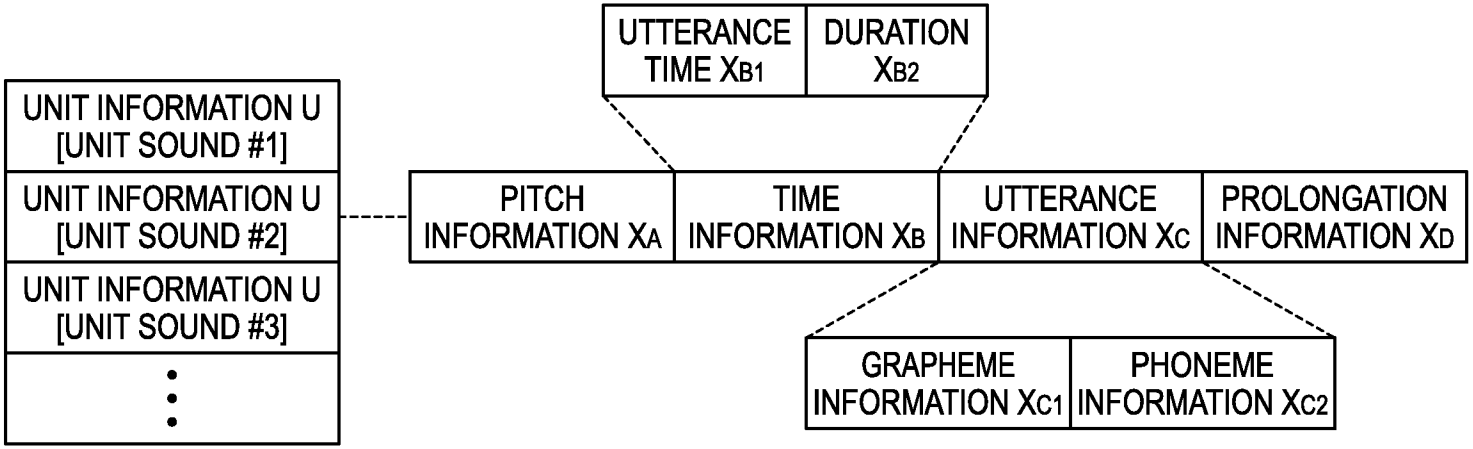
FIG. 2 is a schematic view of synthesis information.

The synthesis information DB stored in the storage device 14 is data (score data) that chronologically (in a time-serial manner) specifies the synthesized sound as the object of sound synthesis, and as shown in FIG. 2, includes a plurality of pieces of unit information U corresponding to different unit sounds (musical notes). The unit sound is, for example, a unit of synthesis corresponding to one musical note. The pieces of unit information U each specify pitch information XA, time information XB, utterance information XC and prolongation information XD. Here, information other than the elements shown above (for example, variables for controlling musical expressions of each unit sound such as the volume and the vibrato) may be included in the unit information U. The information acquirer 34 of FIG. 1 generates and edits the synthesis information DB in response to an instruction from the user.

The pitch information XA of FIG. 2 specifies the pitch (the note number corresponding to the pitch) of the unit sound. The frequency corresponding to the pitch of the unit sound may be specified by the pitch information XA. The time information XB specifies the utterance period of the unit sound on the time axis. The time information XB of the first embodiment specifies, as shown in FIG. 2, an utterance time XB1 indicating the time at which the utterance of the unit sound starts and a duration XB2 indicating the time length (phonetic value) for which the utterance of the unit sound continues. The duration XB2 may be specified by the utterance time XB1 and the sound vanishing time of each unit sound.

The utterance information XC is information that specifies the utterance content (grapheme) of the unit sound, and includes grapheme information XC1 and phoneme information XC2. The grapheme information XC1 specifies the uttered letters (grapheme) expressing the utterance content of each unit sound. In the first embodiment, one syllable of uttered letters (for example, a letter string of lyrics) corresponding to one unit sound is specified by the grapheme information XC1. The phoneme information XC2 specifies the phonemic symbols of a plurality of phonemes corresponding to the uttered letters specified by the grapheme information XC1. The grapheme information XC1 is not an essential element for the synthesis of the unit sounds and may be omitted.

The prolongation information XD of FIG. 2 specifies whether the timewise prolongation is permitted or inhibited for each of a plurality of phonemes corresponding to the utterance content specified by the utterance information XC (that is, the phonemes of the phonemic symbols specified by the phoneme information XC2). For example, a sequence of flags expressing whether the prolongation of the phonemes is permitted or inhibited as two values (a numeric value "1" indicating permission of the prolongation and a numeric value "0" indicating inhibition of the prolongation) is used as the prolongation information XD. The prolongation information XD of the first embodiment specifies whether the prolongation is permitted or inhibited for the sustained phonemes and does not specify whether the prolongation is permitted or inhibited for the non-sustained phonemes. For the non-sustained phonemes, the prolongation may be inhibited at all times. The prolongation setter 36 of FIG. 1 sets whether the prolongation is permitted or inhibited (prolongation information XD) for each of a plurality of phonemes (sustained phonemes) of each unit sound.

Figure 3:
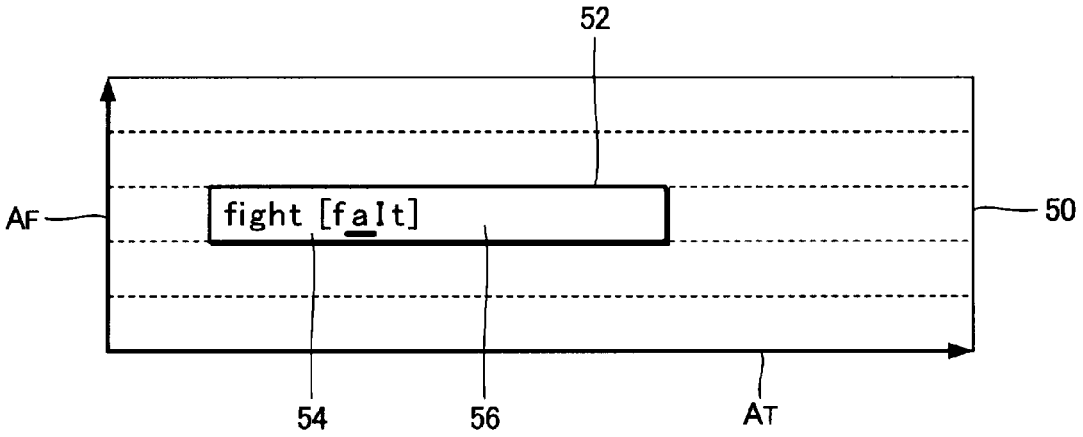
FIG. 3 is a schematic view of a musical score area.

The display controller 32 of FIG. 1 displays an edit screen of FIG. 3 expressing the contents of the synthesis information DB (the time series of a plurality of unit sounds) on the display device 22. As shown in FIG. 3, the edit screen displayed on FIG. 22 includes a musical score area 50. The musical score area 50 is a piano role type coordinate plane where mutually intersecting time axis (lateral axis) AT and pitch axis (longitudinal axis) AF are set. A figure (hereinafter, referred to as "sound indicator") 52 symbolizing each unit sound is disposed in the musical score area 50. The concrete format of the edit screen is not limited to a specific one. For example, a configuration in which the contents of the synthesis information DB is displayed in a list form and a configuration in which the unit sounds are displayed in a musical score form may also be adopted.

The user can instructs the sound synthesizing apparatus 100 to dispose the sound indicator 52 (add a unit sound) in the musical score area 50 by operating the input device 24. The display controller 32 disposes the sound indicator 52 specified by the user in the musical score area 50, and the information acquirer 34 adds to the synthesis information DB the unit information U corresponding to the sound indicator 52 disposed in the musical score area 50. The pitch information XA of the unit information U corresponding to the sound indicator 52 disposed by the user is selected in accordance with the position of the sound indicator 52 in the direction of the pitch axis AF. The utterance time XB1 of the time information XB of the unit information U corresponding to the sound indicator 52 is selected in accordance with the position of the sound indicator 52 in the direction of the time axis AT, and the duration XB2 of the time information XB is selected in accordance with the display length of the sound indicator 52 in the direction of the time axis AT. In response to an instruction from the user on the previously-disposed sound indicator 52 in the musical score area 50, the display controller 32 changes the position of the sound indicator 52 and the display length thereof on the time axis AT, and the information acquirer 34 changes the pitch information XA and the time information XB of the unit information U corresponding to the sound indicator 52.

By appropriately operating the input device 24, the user can select the sound indicator 52 of a given unit sound in the musical score area 50 and specify a desired utterance content (uttered letters). The information acquirer 34 sets, as the unit information U of the unit sound selected by the user, the grapheme information XC1 specifying the uttered letters specified by the user and the phoneme information XC2 specifying the phonemic symbols corresponding to the uttered letters. The prolongation setter 36 sets the prolongation information XD of the unit sound selected by the user, as the initial value (for example, the numeric value to inhibit the prolongation of each phoneme).

The display controller 32 disposes, as shown in FIG. 3, the uttered letters 54 specified by the grapheme information XC1 of each unit sound and the phonemic symbols 56 specified by the phoneme information XC2, in a position corresponding to the sound indicator 52 of the unit sound (for example, a position overlapping the sound indicator 52 as illustrated in FIG. 3). When the user provides an instruction to change the utterance content of each unit sound, the information acquirer 34 changes the grapheme information XC1 and the phoneme information XC2 of the unit sound in response to the instruction from the user, and the display controller 32 changes the uttered letters 54 and the phonemic symbols 56 displayed on the display device 22, in response to the instruction from the user. In the following description, phonemes will be expressed by symbols conforming to the SAMPA (Speech Assessment Methods Phonetic Alphabet). The expression is similar in the case of the X-SAMPA (eXtended-SAMPA).

Figure 4:
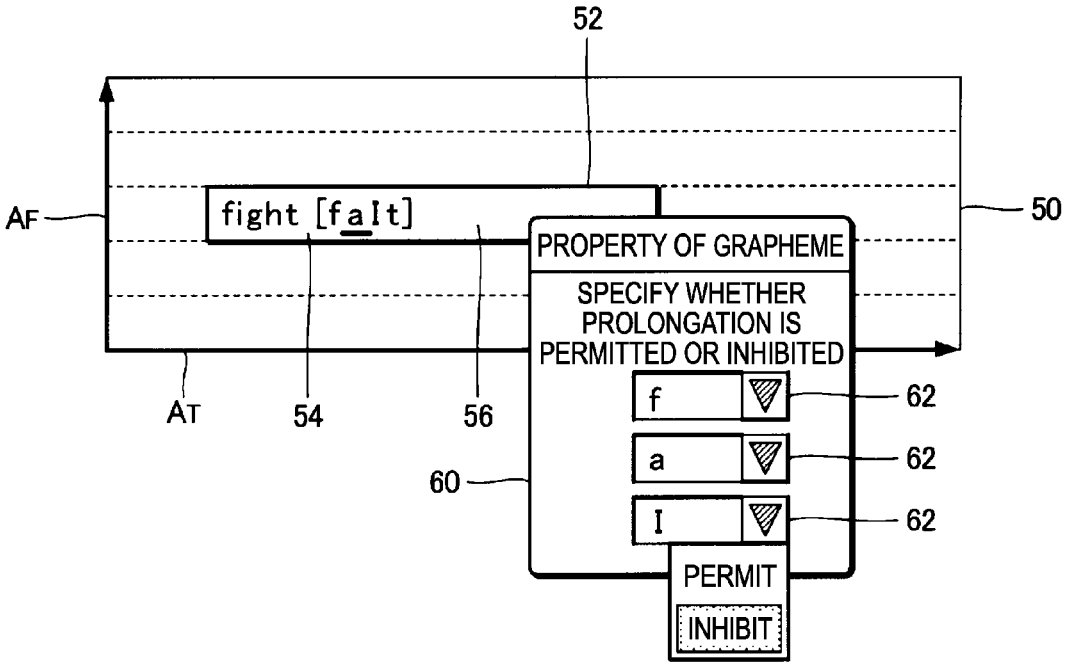
FIG. 4 is a schematic view of the musical score area and a set image.

When the user selects the sound indicator 52 of a desired unit sound (hereinafter, referred to as "selected unit sound") and applies a predetermined operation to the input device 24, as shown in FIG. 4, the display controller 32 displays a set image 60 in a position corresponding to the sound indicator 52 of the selected unit sound (in FIG. 4, the unit sound corresponding to uttered letters "fight") (for example, in the neighborhood of the sound indicator 52). The set image 60 is an image for presenting to the user a plurality of phonemes corresponding to the utterance content of the selected unit sound (a plurality of phonemes specified by the phoneme information XC2 of the selected unit sound) and accepting from the user an instruction as to whether the prolongation of each phoneme is permitted or inhibited.

As shown in FIG. 4, the set image 60 includes operation images 62 for a plurality of phonemes (in the first embodiment, sustained phonemes) corresponding to the utterance content of the selected unit sound, respectively. By operating the operation image 62 of a desired phoneme in the set image 60, the user can arbitrarily specify whether the prolongation of the phoneme is permitted or inhibited (permission/inhibition). The prolongation setter 36 updates the permission or inhibition of the prolongation specified by the prolongation information XD of the selected unit sound for each phoneme, in response to an instruction from the user to the set image 60. Specifically, the prolongation setter 36 sets the prolongation information XD of the phoneme the permission of prolongation of which is specified, to the numeric value "1", and sets the prolongation information XD of the phoneme the inhibition of prolongation of which is specified, to the numeric value "0".

The display controller 32 displays on the display device 22 the phonemic symbol 56 of the phoneme the prolongation information XD of which indicates permission of the prolongation and the phonemic symbol 56 of the phoneme the prolongation information XD of which indicates inhibition of the prolongation in different modes (modes that the user can visually distinguish from each other). FIGS. 3 and 4 illustrate a case where the phonemic symbol 56 of the phoneme /a/ the permission of prolongation of which is specified is underlined and the phonemic symbols 56 of the phonemes the prolongation of which is inhibited are not underlined. However, the different modes are not limited to the underlined phonemic symbol and the non-underlined phonemic symbol. Here, the following configurations may be adopted: a configuration in which display modes such as the highlighting, for example, brightness (gradation), the chroma, the hue, the size and the letter type of the phonemic symbols 56 are made different according to whether the prolongation is permitted or inhibited; a configuration in which the display modes such as an underlined part, a circle, and a dot is applied to the phoneme the prolongation of which is permitted as the phonemic symbol, and a configuration in which the display modes of the backgrounds of the phonemic symbols 56 are made different according to whether the prolongation of the phoneme is permitted or inhibited (for example, a configuration in which the patterns of the backgrounds are made different and a configuration in which the presence or absence of blinking is made different).

The sound synthesizer 38 of FIG. 1 alternately connects on the time axis a plurality of sound fragments (fragment data P) corresponding to the utterance information XC of each of the unit sounds chronologically specified by the synthesis information DB generated by the information acquirer 34, thereby generating the sound signal S of the synthesized sound. Specifically, the sound synthesizer 38 first successively selects the pieces of fragment data P of the sound fragments corresponding to the utterance information XC (the phonemic symbols indicated by the phoneme information XC2) of each unit sound, from the sound fragment group DA of the storage device 14, and secondly, adjusts each piece of fragment data P to the pitch specified by the pitch information XA of the unit information U and the time length specified by the duration XB2 of the time information XB. Thirdly, the sound synthesizer 38 disposes the pieces of fragment data P having the pitch and time length thereof adjusted, at the time specified by the utterance time XB1 of the time information XB and interconnects them, thereby generating the sound signal S. The sound signal S generated by the sound synthesizer 38 is supplied to the sound emitting device 26 and reproduced as a sound wave.

Figure 5:
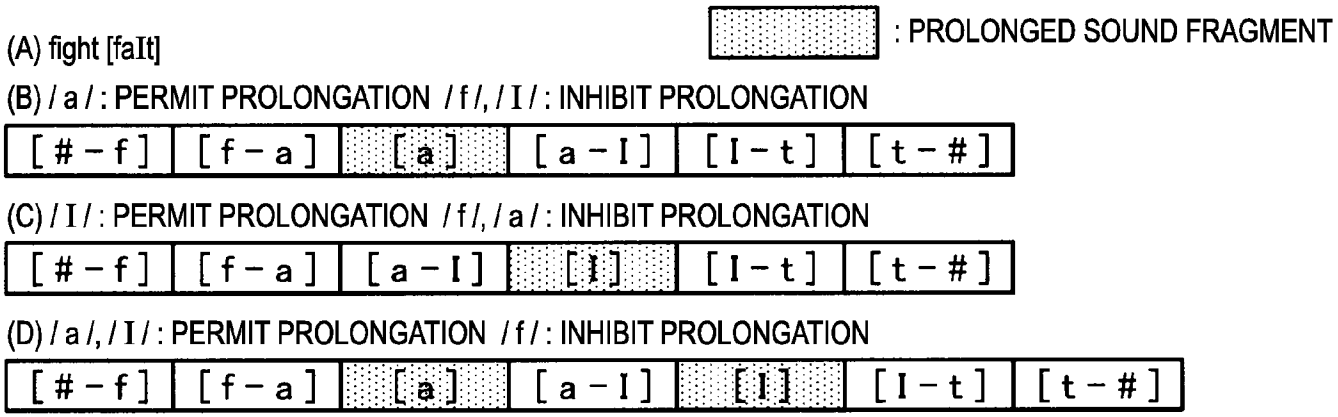
FIG. 5 is an explanatory view of an operation (prolongation of sound fragments) of a sound synthesizer.
Figure 6:
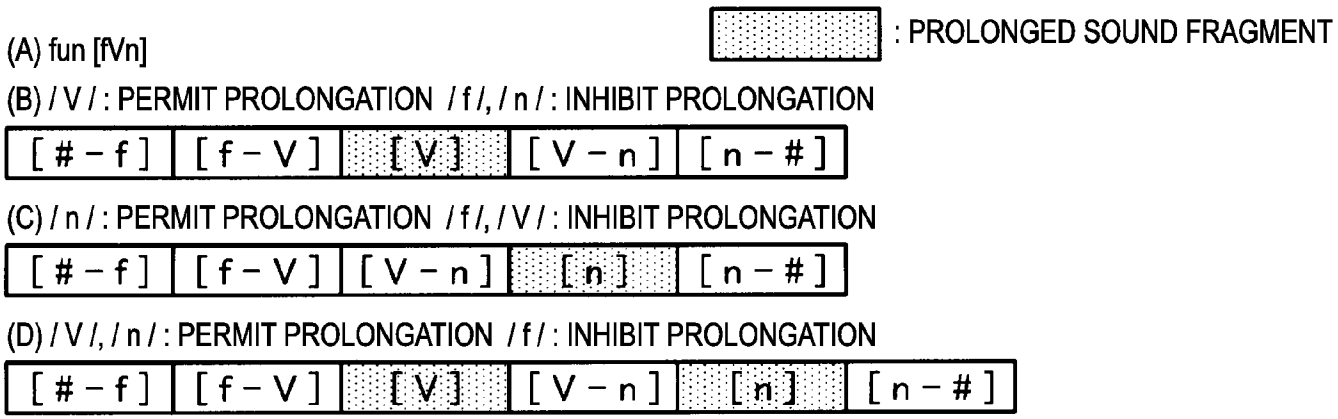
FIG. 6 is an explanatory view of an operation (prolongation of sound fragments) of the sound synthesizer.

FIGS. 5 and 6 are explanatory views of the processing in which the sound synthesizer 38 prolongs the pieces of fragment data P. In the following description, the sound fragments are expressed by using brackets [ ] for descriptive purposes for distinction from the expression of phonemes. For example, the sound fragment of the phoneme chain (diphthong) of the phoneme /a/ and the phoneme /l/ is expressed as a symbol [a-l]. Silence is expressed by using "#" as one phoneme for description purposes.

Part (A) of FIG. 5 shows as an example one syllable of uttered letters "fight" where a phoneme /f/ (voiceless labiodental fricative), a phoneme /a/(open mid-front unrounded vowel), a phoneme /l/ (near-close near-front unrounded vowel) and a phoneme /t/ (voiceless alveolar plosive) are continuous. The phoneme /a/ and the phoneme /l/ constitute a polyphthong (diphthong). For each of the phonemes (/f/, /a/ and /l/) of the uttered letters "fight" which phonemes are sustained phonemes, whether the prolongation is permitted or inhibited is individually specified in response to an instruction from the user to the set image 60. On the other hand, the plosive /t/ which is a non-sustained phoneme is excluded from the objects to be prolonged.

When the prolongation information XD of the phoneme /a/ specifies permission of the prolongation and the prolongation information XD of each of the phoneme /f/ and the phoneme /l/ specifies inhibition of the prolongation, as shown in part (B) of FIG. 5, the sound synthesizer 38 selects the fragment data P of each of the sound fragments [#-f], [f-a], [a], [a-l], [l-t] and [t-#] from the sound fragment group DA, and prolongs the fragment data P of the sound fragment [a] corresponding to the phoneme /a/ the prolongation of which is permitted, to the time length corresponding to the duration XB2 (a time length where the duration of the entire unit sound is the duration XB2). The fragment data P of the sound fragment [a] expresses the section, of the sound produced by uttering the phoneme /a/, during which the waveform is maintained stationary. For the prolongation of the sound fragment (fragment data P), a known technology is arbitrarily adopted. For example, the sound fragment is prolonged by repeating a specific section (for example, a section corresponding to one period) of the sound fragment on the time axis. On the other hand, the fragment data P of each of the sound fragments ([#-f], [f-a], [a-l], [l-t] and [t-#]) including the phonemes (/f/, /l/ and /t/) the prolongation of which is inhibited is not prolonged.

When the prolongation information XD of the phoneme /l/ specifies permission of the prolongation and the prolongation information XD of each of the phoneme /f/ and the phoneme /a/ specifies inhibition of the prolongation, as shown in part (C) of FIG. 5, the sound synthesizer 38 selects the sound fragments [#-f], [f-a], [a-l], [l], [l-t] and [t-#], and prolongs the sound fragment [l] corresponding to the phoneme /l/ the prolongation of which is permitted, to the time length corresponding to the duration XB2. On the other hand, the fragment data P of each of the sound fragments ([#-f], [f-a], [a-l], [l-t] and [t-#]) including the phonemes (/f/, /a/ and /t/) the prolongation of which is inhibited is not prolonged.

When the prolongation information XD of each of the phoneme /a/ and the phoneme /l/ specifies permission of the prolongation and the prolongation information XD of the phoneme /f/ specifies inhibition of the prolongation, as shown in part (D) of FIG. 5, the sound synthesizer 38 selects the sound fragments [#-f], [f-a], [a], [a-l], [l] [l-t] and [t-#], and prolongs the sound fragment [a] of the phoneme /a/ and the sound fragment [l] of the phoneme /l/ to the time length corresponding to the duration XB2.

Part (A) of FIG. 6 shows as an example one syllable of uttered letters "fun" where a phoneme /f/ (voiceless labiodental fricative), a phoneme /V/ (open-mid back unrounded vowel) and a phoneme /n/ (alveolar nasal) are continuous. For each of the phonemes (sustained phonemes) /f/, /V/ and /n/ constituting the uttered letters, whether the prolongation is permitted or inhibited is individually specified in response to an instruction from the user.

When the prolongation information XD of the phoneme /V/ specifies permission of the prolongation and the prolongation information XD of each of the phoneme /f/ and the phoneme /n/ specifies inhibition of the prolongation, as shown in part (B) of FIG. 6, the sound synthesizer 38 selects the sound fragments [#-f], [f-V], [V], [V-n] and [n-#], and prolongs the sound fragment [V] corresponding to the phoneme /V/ the prolongation of which is permitted, to the time length corresponding to the duration XB2. The sound fragments ([#-f], [f-V], [V-n] and [n-#]) including the phonemes (/f/ and /n/) the prolongation of which is inhibited are not prolonged.

On the other hand, when the prolongation information XD of the phoneme /n/ specifies permission of the prolongation and the prolongation information XD of each of the phoneme /f/ and the phoneme /V/ specifies inhibition of the prolongation, as shown in part (C) of FIG. 6, the sound synthesizer 38 selects the sound fragments [#-f], [f-V], [V-n], [n] and [n-#], and prolongs the sound fragment [n] corresponding to the phoneme /n/ the prolongation of which is permitted, to the time length corresponding to the duration XB2. The sound fragments ([#-f], [f-V], [V-n] and [n-#]) including the phonemes (/f/ and /V/) the prolongation of which is inhibited are not prolonged.

When the prolongation information XD of each of the phoneme /V/ and the phoneme /n/ specifies permission of the prolongation and the prolongation information XD of the phoneme /f/ specifies inhibition of the prolongation, as shown in part (D) of FIG. 6, the sound synthesizer 38 selects the sound fragments [#-f], [f-V], [V], [V-n], [n] and [n-#], and prolongs the sound fragment [V] of the phoneme /V/ and the sound fragment [n] of the phoneme /n/ are prolonged to the time length corresponding to the duration XB2.

As is understood from the examples shown above, the sound synthesizer 38 prolongs the sound fragment corresponding to a phoneme the prolongation of which is permitted by the prolongation setter 36 among a plurality of phonemes corresponding to the utterance content of one unit sound according to the duration XB2 of the unit sound. Specifically, the sound fragment corresponding to an individual phoneme the prolongation of which is permitted by the prolongation setter 36 (the sound fragments [a] and [l] in the example shown in FIG. 5 and the sound fragments [V] and [n] in the exemplification of FIG. 6) is selected from the sound fragment group DA, and prolonged according to the duration XB2.

As described above, according to the first embodiment, since whether the prolongation is permitted or inhibited is individually set for each of a plurality of phonemes corresponding to the utterance content of one unit sound, the restriction on the prolongation of the sound fragments can be eased, for example, compared with a configuration in which the sound fragment of the first one vowel of a polyphthong is prolonged. Consequently, an advantage that a variety of synthesized sounds can be generated is offered. For example, for the uttered letters "fight" shown as an example in FIG. 5, a synthesized sound "[fa:lt]" where the phoneme /a/ is prolonged (part (B) of FIG. 5), a synthesized sound "[fal:t]" where the phoneme /l/ is prolonged (part (C) of FIG. 5) and a synthesized sound "[fa:l:t]" where both the phoneme /a/ and the phoneme /l/ are prolonged (part (D) of FIG. 5) can be generated. Particularly in the first embodiment, since whether the prolongation of each phoneme is permitted or inhibited is set in response to an instruction from the user, an advantage is offered that a variety of synthesized sounds conforming to the user's intension can be generated.

Second Embodiment

A second embodiment of the present disclosure will be described. In the modes shown below as examples, elements the action and function of which are similar to those in the first embodiment are also denoted by the reference designations referred to in the description of the first embodiment, and detailed descriptions thereof are omitted as appropriate.

Figure 7:
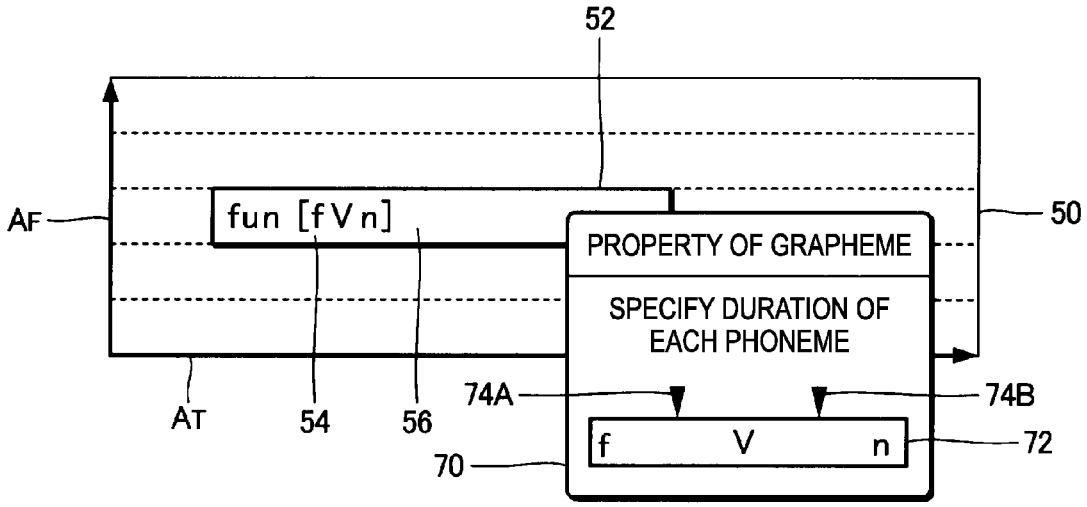
FIG. 7 is a schematic view of a musical score area and a set image in a second embodiment.

FIG. 7 is a schematic view of a set image 70 that the display controller 32 of the second embodiment displays on the display device 22. Like the set image 60 of the first embodiment, the set image 70 of the second embodiment is an image that presents to the user a plurality of phonemes corresponding to the utterance content of the selected unit sound selected from the musical score area 50 by the user and accepts from the user an instruction as to whether the prolongation of each phoneme is permitted or inhibited. Specifically, as shown in FIG. 7, the set image 70 includes a sound indicator 72 corresponding to the selected unit sound and operation images 74 (74A and 74B) to indicate the boundaries between phonemes in tandem of a plurality of phonemes of the selected unit sound. The sound indicator 72 is a strip-shaped (or linear) figure extending in the direction of the time axis AT (lateral direction) to express the utterance section of the selected unit sound. By appropriately operating the input device 24, the user can arbitrarily move the operation images 74 in the direction of the time axis AT. The display lengths of the sections into which the sound indicator 72 is divided at the points of time of the operation images 74 correspond to the durations of the phonemes of the selected unit sound. Specifically, the duration of the first phoneme /f/ of the three phonemes (/f/, /V/ and /n/) corresponding to uttered letters "fun" is defined as the distance between the left end of the sound indicator 72 and the operation image 74A, the duration of the phoneme /V/ is defined as the distance between the operation image 74A and the operation image 74B, and the duration of the last phoneme /n/ is defined as the distance between the operation image 74B and the right end of the sound indicator 72.

The prolongation setter 36 of the second embodiment sets whether the prolongation of each phoneme is permitted or inhibited, in accordance with the positions of the operation images 74 in the set image 70. The sound synthesizer 38 prolongs each sound fragment so that the durations of the phonemes corresponding to one unit sound conform with the ratio among the durations of the phonemes specified on the set image 70. That is, in the second embodiment, as in the first embodiment, whether the prolongation is permitted or inhibited is individually set for each of a plurality of phonemes of each unit sound. Consequently, similar effects to those of the first embodiment are achieved in the second embodiment.

<Modifications>

The above-described modes may be modified variously. Concrete modifications will be shown below. Two or more modifications arbitrarily selected from among the modifications shown below may be merged as appropriate.

(1) While a case where a synthesized sound which is an utterance of English (the uttered letters "fight" and "fun") is generated is shown as an example in the above-described embodiments, the language of the synthesized sound is arbitrary. In some languages, there are cases where a one-syllable phoneme chain of a first consonant, a vowel and a second consonant (C-V-C) can be specified as the uttered letters of one unit sound. For example, in Korean, a phoneme chain consisting of a first consonant, a vowel and a second consonant is present. The phoneme chain includes the second consonant (a consonant situated at the end of a syllable) called "patchim". When the first consonant and the second consonant are sustained phonemes, as in the above-described first and second embodiments, a configuration is suitable in which whether the prolongation of each of the first consonant, the vowel and the second consonant is permitted or inhibited is individually set. For example, when one-syllable uttered letters "han" constituted by a phoneme /h/ of the first consonant, a phoneme /a/ of the vowel and a phoneme /n/ of the second consonant are specified as one unit sound, a synthesized sound "[ha:n]" where the phoneme /a/ is prolonged and a synthesized sound "[han:]" where the phoneme /n/ is prolonged can be selectively generated.

While FIG. 5 referred to in the first embodiment shows as an example the uttered letters "fight" including a diphthong where a phoneme /a/ and a phoneme /l/ are continuous in one syllable, in Chinese, a polyphthong (triphthong) where three vowels are continuous in one syllable can be specified as the uttered letters of one unit sound. Therefore, a configuration is suitable in which whether the prolongation is permitted or inhibited is individually set for each of the phonemes of the three vowels of the triphthong.

(2) While the information acquirer 34 generates the synthesis information DB in response to an instruction from the user in the above-described modes, the following configurations may be adopted: a configuration in which the information acquirer 34 acquires the synthesis information DB from an external apparatus, for example, through a communication network; and a configuration in which the information acquirer 34 acquires the synthesis information DB from a portable recording medium. That is, the configuration in which the synthesis information DB is generated or edited in response to an instruction from the user may be omitted. As is understood from the above description, the information acquirer 34 is embraced as an element that acquires the synthesis information DB (an element that acquires the synthesis information DB from an external apparatus or an element that generates the synthesis information DB by itself).

Figure 8:
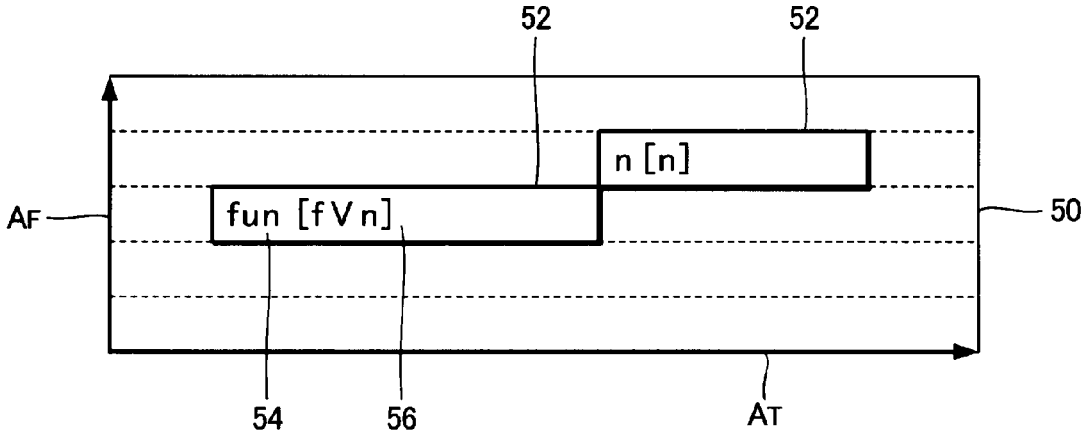
FIG. 8 is a schematic view of a musical score area in a modification.

(3) While a case where one syllable of uttered letters are specified as one unit sound is shown in the above-described modes, one syllable of uttered letters may be assigned to a plurality of unit sounds. For example, as shown in FIG. 8, the whole of one syllable of uttered letters "fun" and the last phoneme /n/ thereof may be assigned to different unit sounds. According to this configuration, the pitch can be changed within one syllable of a synthesized sound.

(4) While a configuration in which whether the prolongation is permitted or inhibited is not specified for the non-sustained phonemes is shown in the above-described embodiments, a configuration in which whether the prolongation is permitted or inhibited can be specified for the non-sustained phonemes may be adopted. The sound fragments of the non-sustained phonemes include the silent sections of the non-sustained phonemes before utterance. Therefore, when the prolongation is permitted for the non-sustained phonemes, the sound synthesizer 38 prolongs, for example, the silent sections of the sound fragments of the non-sustained phonemes.

Here, the details of the above embodiments are summarized as follows.

A sound synthesizing apparatus of the present disclosure includes: an information acquirer (for example, information acquirer 34) for acquiring synthesis information that specifies a duration and an utterance content for each unit sound, a prolongation setter (for example, prolongation setter 36) for setting whether prolongation is permitted or inhibited for each of a plurality of phonemes corresponding to the utterance content of each unit sound, and a sound synthesizer (for example, sound synthesizer 38) for generating a synthesized sound corresponding to the synthesis information by connecting a plurality of sound fragments corresponding to the utterance content of the each unit sound, the sound synthesizer prolongs, among a plurality of phonemes corresponding to the utterance content of the each unit sound, a sound fragment corresponding to the phoneme the prolongation of which is permitted by the prolongation setter, according to the duration of the unit sound.

According to this configuration, since whether the prolongation is permitted or inhibited is set for each of a plurality of phonemes corresponding to the utterance content of each unit sound, an advantage is offered that compared with the configuration in which, for example, the first phoneme of a plurality of phonemes (for example, a polyphthong) corresponding to each unit sound is prolonged at all times, the limitation on the prolongation of sound fragments at the time of synthesized sound generation is eased and a variety of synthesized sounds can be generated as a result.

For example, the prolongation setter sets whether the prolongation of each phoneme is permitted or inhibited in response to an instruction from a user.

According to this configuration, since whether the prolongation of each phoneme is permitted or inhibited is set in response to an instruction from the user, an advantage is offered that a variety of synthesized sounds conforming to the user's intension can be generated. For example, a sound synthesizing apparatus is provided with a first display controller (for example, display controller 32) for providing a plurality of phonemes corresponding to the utterance content of a unit sound selected by the user among a plurality of unit sounds specified by the synthesis information, and displaying a set image (for example, set image 60 or set image 70) that accepts from the user an instruction as to whether the prolongation of each phoneme is permitted or inhibited.

According to this configuration, since the set image which provides a plurality of phonemes corresponding to a unit sound selected by the user and accepts an instruction from the user is displayed on a display device, an advantage is offered that the user can easily specify whether the prolongation of each phoneme is permitted or inhibited for each of a plurality of unit sounds.

A sound synthesizing apparatus is provided with a second display controller (for example, display controller 32) for displaying on a display device a phonemic symbol of each of a plurality of phonemes corresponding to the utterance content of each unit sound so that a phoneme the prolongation of which is permitted by the prolongation setter and a phoneme the prolongation of which is inhibited by the prolongation setter are displayed in different display modes. According to this configuration, since the phonemic symbols of the phonemes are displayed in different display modes according to whether the prolongation is permitted or inhibited, an advantage is offered that the user can easily check whether the prolongation of each phoneme is permitted or inhibited. The display mode means image characteristics that the user can visually discriminate, and typical examples of the display mode are the brightness (gradation), the chroma, the hue and the format (the letter type, the letter size, the presence or absence of highlighting such as an underline). Moreover, in addition to the configuration in which the display modes of the phonemic symbols themselves are made different, a configuration may be embraced in which the display modes of the backgrounds (grounds) of the phonemic symbols are made different according to whether the prolongation of the phonemes is permitted or inhibited. For example, the following configurations are adopted: a configuration in which the patterns of the backgrounds of the phonemic symbols are made different; and a configuration in which the backgrounds of the symbols are blinked.

Also, the prolongation setter sets whether the prolongation is permitted or inhibited for, of a plurality of phonemes corresponding to the utterance content of each unit sound, a sustained phoneme that is sustainable timewise.

According to this configuration, since whether the prolongation is permitted or inhibited is set for the sustained phoneme, an advantage is offered that a synthesized sound can be generated with an auditorily natural sound being maintained for each phoneme.

The sound synthesizing apparatus according to the above-described modes is implemented by a cooperation between a general-purpose arithmetic processing unit such as a CPU (central processing unit) and a program as well as implemented by hardware (electronic circuit) such as a DSP (digital signal processor) exclusively used for synthesized sound generation. The program of the present disclosure causes a computer to execute: information acquiring processing for acquiring synthesis information that specifies a duration and an utterance content for each unit sound; prolongation setting processing for setting whether prolongation is permitted or inhibited for each of a plurality of phonemes corresponding to the utterance content of each unit sound; and sound synthesizing processing for generating a synthesized sound corresponding to the synthesis information by connecting a plurality of sound fragments corresponding to the utterance content of each unit sound, the sound synthesizing processing prolonging, of a plurality of phonemes corresponding to the utterance content of each unit sound, a sound fragment corresponding to the phoneme the prolongation of which is permitted by the prolongation setting processing, according to the duration of the unit sound. According to this program, similar workings and effects to those of a music data editing apparatus of the present disclosure are realized. The program of the present disclosure is installed on a computer by being provided in the form of distribution through a communication network as well as installed on a computer by being provided in the form of being stored in a computer readable recording medium.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2012-074858 filed on Mar. 28, 2012, the contents of which are incorporated herein by reference.

What is claimed is:

1. A sound synthesizing method comprising:

acquiring synthesis information which specifies a duration and an utterance content for a unit sound;

displaying a set image, wherein the set image presents a plurality of phonemes including a first phoneme and a second phoneme, the plurality of phonemes corresponding to the utterance content of the unit sound, the unit sound selected by a user among a plurality of unit sounds, wherein the plurality of unit sounds is specified by the synthesis information, and wherein a user instruction is accepted, via user interaction with the set image, as to whether the prolongation of each of the plurality of phonemes is permitted or inhibited;

displaying on a display device a plurality of phonemic symbols including a first phonemic symbol and a second phonemic symbol, each phonemic symbol displayed for a respective phoneme of the plurality of phonemes corresponding to the utterance content of the unit sound such that the first phonemic symbol is displayed in a first display mode for the first phoneme, the prolongation of which is permitted, and the second phonemic symbol is displayed in a second display mode for the second phoneme, the prolongation of which is inhibited, wherein the user interaction with the set image includes a user interaction with one or more of the plurality of phonemic symbols, wherein each phonemic symbol is one or more characters;

setting, in response to the user instruction, whether prolongation is permitted or inhibited for each of the plurality of phonemes corresponding to the utterance content of the unit sound, based on the user interaction with one or more of the plurality of phonemic symbols; and generating a synthesized sound corresponding to the synthesis information by connecting together a plurality of sound fragments corresponding to the utterance content of the unit sound, wherein in the generating process, a first sound fragment of the plurality of sound fragments is prolonged in accordance with the duration of the unit sound, the first sound fragment corresponding to the first phoneme, the prolongation of which is permitted.

2. The sound synthesizing method according to claim 1, wherein in the first display mode, the first phonemic symbol has at least one of highlighting, an underlined part, a circle, and a dot applied to the first phoneme the prolongation of which is permitted.

3. The sound synthesizing method according to claim 1, wherein the setting process includes setting whether prolongation is permitted or inhibited for a sustained phoneme which is sustainable timewise.

4. The sound synthesizing method according to claim 1, further comprising:

displaying another set image, wherein the another set image presents another plurality of phonemes corresponding to another utterance content of another unit sound, the another unit sound selected by the user among another plurality of unit sounds specified by the synthesis information, and wherein another user instruction is accepted, via another user interaction with the another set image, as to durations of the another plurality of phonemes; and generating another synthesized sound corresponding to the synthesis information by connecting together another plurality of sound fragments corresponding to the another utterance content of the another unit sound, wherein in the generating process of the another synthesized sound, one or more sound fragments of the another plurality of sound fragments corresponding to another utterance content of the another unit sound are prolonged such that the duration of a phoneme of the another plurality of phonemes conforms with a ratio among the durations of the another plurality of phonemes specified by the another user instruction accepted via the another user interaction with the another set image.

5. A sound synthesizing apparatus comprising:

a processor coupled to a memory, the processor configured to execute computer-executable units comprising:

an information acquirer adapted to acquire synthesis information which specifies a duration and an utterance content for a unit sound;

a display controller adapted to:

display a set image, wherein the set image presents a plurality of phonemes including a first phoneme and a second phoneme, the plurality of phonemes corresponding to the utterance content of the unit sound, the unit sound selected by user among a plurality of unit sounds, wherein the plurality of unit sounds is specified by the synthesis information, and wherein a user instruction is accepted, via user interaction with the set image, as to whether the prolongation of each of the plurality of first phonemes is permitted or inhibited, display a plurality of phonemic symbols including a first phonemic symbol and a second phonemic symbol, each phonemic symbol displayed for a respective phoneme of the plurality of phonemes corresponding to the utterance content of the unit sound such that the first phonemic symbol is displayed in a first display mode for the first phoneme, the prolongation of which is permitted, and the second phonemic symbol is displayed in a second display mode for the second phoneme, the prolongation of which is inhibited, wherein the user interaction with the set image includes user interaction with one or more of the plurality of phonemic symbols, wherein each phonemic symbol is one or more characters;

a prolongation setter adapted to set, in response to the user instruction, whether prolongation is permitted or inhibited for each of the plurality of phonemes corresponding to the utterance content of the unit sound, based on the user interaction with one or more of the plurality of phonemic symbols; and a sound synthesizer adapted to generate a synthesized sound corresponding to the synthesis information by connecting together a plurality of sound fragments corresponding to the utterance content of the unit sound, wherein the sound synthesizer prolongs a first sound fragment of the plurality of sound fragments in accordance with the duration of the unit sound, the first sound fragment corresponding to the first phoneme, the prolongation of which is permitted.

6. A non-transitory computer-readable medium having stored thereon a program for causing a computer to implement a sound synthesizing method comprising:

acquiring synthesis information which specifies a duration and an utterance content for a unit sound;

displaying a set image, wherein the set image presents a plurality of phonemes including a first phoneme and a second phoneme, the plurality of phonemes corresponding to the utterance content of the unit sound, the unit sound selected by a user among a plurality of unit sounds, wherein the plurality of unit sounds is specified by the synthesis information, and wherein a user instruction is accepted, via user interaction with the set image, as to whether the prolongation of each of the plurality of phonemes is permitted or inhibited;

displaying on a display device a plurality of phonemic symbols including a first phonemic symbol and a second phonemic symbol, each phonemic symbol displayed for a respective phoneme of the plurality of phonemes corresponding to the utterance content of the unit sound such that the first phonemic symbol is displayed in a first display mode for the first phoneme, the prolongation of which is permitted, and the second phonemic symbol is displayed in a second display mode for the second phoneme, the prolongation of which is inhibited, wherein the user interaction with the set image includes user interaction with one or more of the plurality of phonemic symbols, wherein each phonemic symbol is one or more characters;

setting, in response to the user instruction, whether prolongation is permitted or inhibited for each of the plurality of phonemes corresponding to the utterance content of the unit sound, based on the user interaction with one or more of the plurality of phonemic symbols; and generating a synthesized sound corresponding to the synthesis information by connecting together a plurality of sound fragments corresponding to the utterance content of the unit sound, wherein in the generating process, a first sound fragment of the plurality of sound fragments is prolonged in accordance with the duration of the unit sound, the first sound fragment corresponding to the first phoneme, the prolongation of which is permitted.

7. A sound synthesizing method comprising:

acquiring synthesis information which specifies a duration and an utterance content for a unit sound;

displaying a set image, wherein the set image presents a plurality of phonemes including a first phoneme and a second phoneme, the plurality of phonemes corresponding to the utterance content of the unit sound, the unit sound selected by a user among a plurality of unit sounds, wherein the plurality of unit sounds is specified by the synthesis information, and wherein a user instruction is accepted, via user interaction with the set image, as to whether the prolongation of at least one of the plurality of phonemes is permitted or inhibited;

displaying on a display device a plurality of phonemic symbols including a first phonemic symbol and a second phonemic symbol, each phonemic symbol displayed for a respective phoneme of the plurality of phonemes corresponding to the utterance content of the unit sound such that the first phonemic symbol is displayed in a first display mode for the first phoneme, the prolongation of which is permitted, and the second phonemic symbol is displayed in a second display mode for the second phoneme, the prolongation of which is inhibited, wherein the user interaction with the set image includes user interaction with one or more of the plurality of phonemic symbols, wherein each phonemic symbol is one or more characters;

setting, in response to the user instruction, whether prolongation is permitted or inhibited for the at least one of a plurality of phonemes corresponding to the utterance content of the unit sound, based on the user interaction with one or more of the plurality of phonemic symbols; and generating a synthesized sound corresponding to the synthesis information by connecting together a plurality of sound fragments corresponding to the utterance content of the unit sound, wherein in the generating process, a first sound fragment of the plurality of sound fragments is prolonged in accordance with the duration of the unit sound, the first sound fragment corresponding to the first phoneme, the prolongation of which is permitted.

8. A sound synthesizing apparatus comprising:

a processor coupled to a memory storing a program, the processor, when executing the program, configured for:

acquiring synthesis information which specifies a duration and an utterance content for a unit sound;

displaying a set image, wherein the set image presents a plurality of phonemes including a first phoneme and a second phoneme, the plurality of phonemes corresponding to the utterance content of the unit sound, the unit sound selected by a user among a plurality of unit sounds, wherein the plurality of unit sounds is specified by the synthesis information, and wherein a user instruction is accepted, via user interaction with the set image, as to whether the prolongation of at least one of the plurality of phonemes is permitted or inhibited;

displaying on a display device a plurality of phonemic symbols including a first phonemic symbol and a second phonemic symbol, each phonemic symbol displayed for a respective phoneme of the plurality of phonemes corresponding to the utterance content of the unit sound such that the first phonemic symbol is displayed in a first display mode for the first phoneme, the prolongation of which is permitted, and the second phonemic symbol is displayed in a second display mode for the second phoneme, the prolongation of which is inhibited, wherein the user interaction with the set image includes user interaction with one or more of the plurality of phonemic symbols, wherein each phonemic symbol is one or more characters;

setting, in response to the user instruction, whether prolongation is permitted or inhibited for the at least one of a plurality of phonemes corresponding to the utterance content of the unit sound based on the user interaction with one or more of the plurality of phonemic symbols; and generating a synthesized sound corresponding to the synthesis information by connecting together a plurality of sound fragments corresponding to the utterance content of the unit sound, wherein in the generating, a first sound fragment of the plurality of sound fragments is prolonged in accordance with the duration of the unit sound, the first sound fragment corresponding to the first phoneme, the prolongation of which is permitted.

9. The sound synthesizing apparatus according to claim 8, wherein in the first display mode, the first phonemic symbol has at least one of highlighting, an underlined part, a circle, and a dot applied to the first phoneme the prolongation of which is permitted.

10. The sound synthesizing apparatus according to claim 8, wherein the setting includes setting whether prolongation is permitted or inhibited for a sustained phoneme which is sustainable timewise.

11. The sound synthesizing apparatus according to claim 8, wherein the processor, when executing the program, is configured for:

displaying another set image, wherein the another set image presents another plurality of phonemes corresponding to another utterance content of another unit sound, the another unit sound selected by the user among another plurality of unit sounds specified by the synthesis information, and wherein another user instruction is accepted, via another user interaction with the another set image, as to durations of the another plurality of phonemes; and generating another synthesized sound corresponding to the synthesis information by connecting together another plurality of sound fragments corresponding to the another utterance content of the another unit sound, wherein in the generating of the another synthesized sound, one or more sound fragments of the another plurality of sound fragments corresponding to another utterance content of the another unit sound are prolonged such that the duration of a phoneme of the another plurality of phonemes conforms with a ratio among the durations of the another plurality of phonemes specified by the another user instruction accepted via the another user interaction with the another set image.

* * * * *